US005079813A

United States Patent [19]

Agers et al.

[11] Patent Number: 5,079,813

[45] Date of Patent: Jan. 14, 1992

[54] INTERLACING APPARATUS

[75] Inventors: Brian M. Agers, Wilmington, Del.; Jimmie S. Daughtry, Carolina Beach, N.C.; Arnold S. Goldstein, Wilmington, Del.; Steven B. Johnson; George S. Tuggle, both of Wilmington, N.C.

[73] Assignee: E. I. du Pont de Nemours and Company, Wilmington, Del.

[21] Appl. No.: 571,572

[22] PCT Filed: Feb. 21, 1990

[86] PCT No.: PCT/US90/00921

§ 371 Date: Sep. 7, 1990

§ 102(e) Date: Sep. 7, 1990

[51] Int. Cl.[5] ..... D02G 1/16

[52] U.S. Cl. ..... 28/274

[58] Field of Search ..... 28/271-276

[56] References Cited

U.S. PATENT DOCUMENTS

| | | | |
|---|---|---|---|
| Re. 29,285 | 6/1977 | Christini et al. | 428/426 |
| 2,985,995 | 5/1961 | Bunting et al. | 57/140 |
| 3,115,691 | 12/1963 | Bunting et al. | 28/1 |
| 3,436,798 | 4/1969 | Nicita | 28/1 |
| 3,574,249 | 4/1971 | Cannon | 28/1.4 |
| 3,936,577 | 2/1976 | Christini et al. | 428/426 |
| 4,715,097 | 12/1987 | Bogucki-Land | 28/274 X |
| 4,932,109 | 6/1990 | Harris | 28/271 |

FOREIGN PATENT DOCUMENTS

| | | | |
|---|---|---|---|
| 9179838 | 10/1984 | Japan | 28/274 |
| 1264480 | 2/1972 | United Kingdom | 28/274 |
| 2019906 | 11/1979 | United Kingdom | 28/274 |

*Primary Examiner*—Werner H. Schroeder
*Assistant Examiner*—John J. Calvert

[57] ABSTRACT

Interlace jets are improved by providing yarn passageways that flare outwardly, being defined by surfaces that are gently convexly curved. A preferred stacked interlace jet assembly is provided with jet members of oval configuration.

7 Claims, 2 Drawing Sheets

INTERLACING APPARATUS

FIELD OF THE INVENTION

This invention relates to improvements in interlacing apparatus for multifilamentary yarns, and more particularly to an improved configuration for the yarn passageway in an interlacing jet.

BACKGROUND

The interlacing of multifilamentary yarns was first taught by Bunting and Nelson, e.g., in U.S. Pat. Nos. 2,985,995 and 3,115,691. Interlacing is now conventional for high speed spinning processes. It is desirable to improve the efficiency of the apparatus used for interlacing, commonly referred to as interlacing "jets".

The interlacing effect has generally in practice been achieved by directing streams of high velocity fluid against a planar surface, thereby forming contiguous fluid vortices, and passing a yarn axially between the streams and parallel to the planar surface, as disclosed by Bunting and Nelson. Essentially the same technique is still used today. The planar surface against which the high velocity fluid streams are directed is often referred as a "striker plate". Since several thread lines are generally spun and wound up on a single position of a spinning machine, it is generally convenient to assemble multiple jets into a single unit, e.g. in "stacked" relationship, as shown in FIGS. XI and XII of Christini et al. U.S. Pat. No. 3,936,577 and Reissue 29,285, and as item 12 of FIG. 1 of Harris U.S. Pat. No. 4,932,109, issued June 12, 1990, so that the backside of one jet acts as the striker plate for the adjoining jet. Accordingly, the cross-sectional configuration of these jet members has been rectangular, as indicated in the above Figures. The yarn passageways between adjacent jets in these assemblies have accordingly been slots with parallel sides, i.e., of constant dimensions. Item 12 of Harris' FIG. 1 illustrates an existing jet assembly that has been used by us before the present invention.

SUMMARY OF THE INVENTION

We have now found that a significant improvement in efficiency can be achieved by using such stacked jets with striker surfaces that have a gentle convex curve, instead of being planar. We use jets whose yarn passageways flare outwardly instead of having essentially parallel sides. Preferably, the outward flaring occurs on both sides of the yarn passageway, as when oval-shaped jet members are used as shown in FIG. 1 herein, as opposed to the essentially rectangular shape of the existing jet members referred to above, that define yarn passageways with parallel sides.

Accordingly, the invention provides an improved interlacing jet comprising a striker surface and a wall member containing at least one conduit adapted to project a stream of pressurized fluid against said striker surface, said wall member and said striker surface defining therebetween a passageway with an entrance and an exit at either end for a yarn, the improvement being characterized in that said striker surface is gently convexly curved whereby the entrance and exit of said yarn passageway are flared outwardly with respect to the location where said stream is projected against said striker surface. Preferably both the wall member and the striker surface are convexly curved. Conveniently in a stacked jet assembly, a plurality of yarn passageways may be provided between adjacent jet members with wall members that are convexly curved on one side to provide a striker surface and on another side that contains at least one said conduit or jet.

Thus, a preferred improved stacked interlacing jet assembly comprises a plurality of jet members with walls that are assembled to provide a plurality of yarn passageways between walls of adjacent jet members, said walls containing fluid conduits each adapted to project a stream of pressurized fluid against the opposing wall of the adjacent jet member located on the other side of said yarn passageway, the improvement being characterized in that said yarn passageways are outwardly flared at least downstream from the location of said conduits, and preferably both upstream and downstream. Preferably these walls are curved to provide the outward flaring of the yarn passageways.

Conveniently, according to the invention, a stacked interlacing jet assembly comprises a plurality of jet members, with walls, that are assembled to provide a plurality of yarn passageways between walls of adjacent jet members, said jet members being essentially oval in cross-section and containing fluid conduits located on one side of said yarn passageways, and adapted to project streams of pressurized fluid against the opposing wall of the adjacent jet member located on the other side of said yarn passageways.

Preferably, the jet members are secured by clamps that have surfaces that are convexly curved at least in the vicinity of the yarn passageways to assist in smooth movement of the fluids away from the yarn passages and to minimize build up of deposits, e.g. of finish, on these clamps in the vicinity of the yarn passageways.

DETAILED DESCRIPTION OF INVENTION

Figure 1:
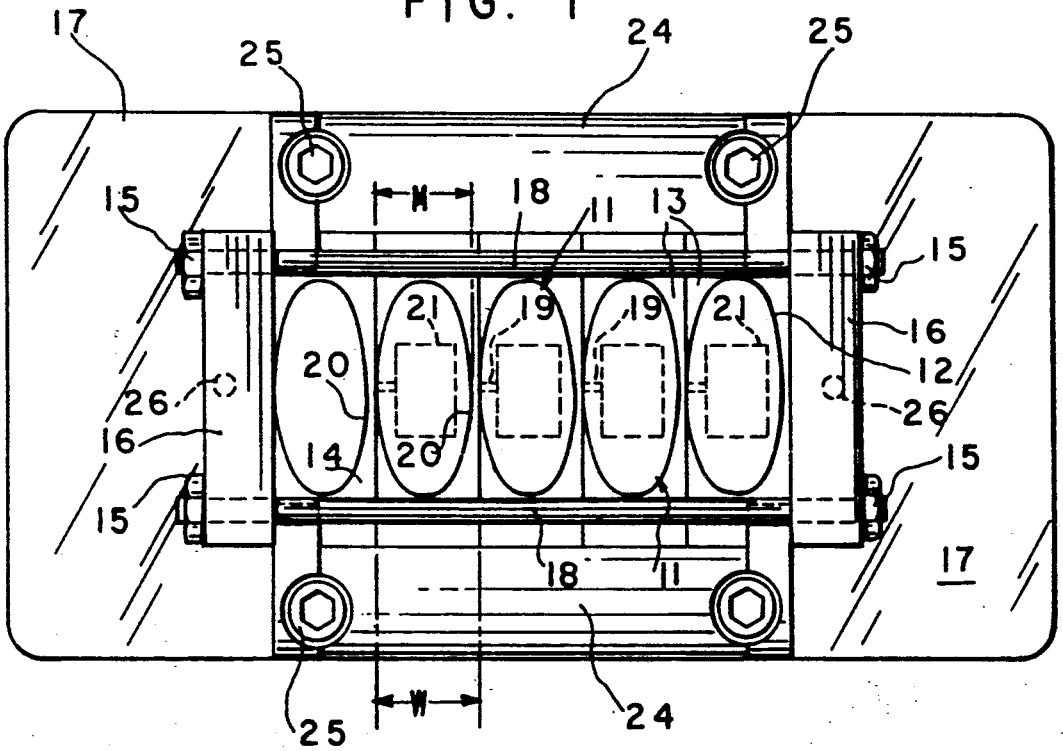
FIG. 1 shows a plan view of a preferred interlacing jet assembly of this invention.
Figure 2:
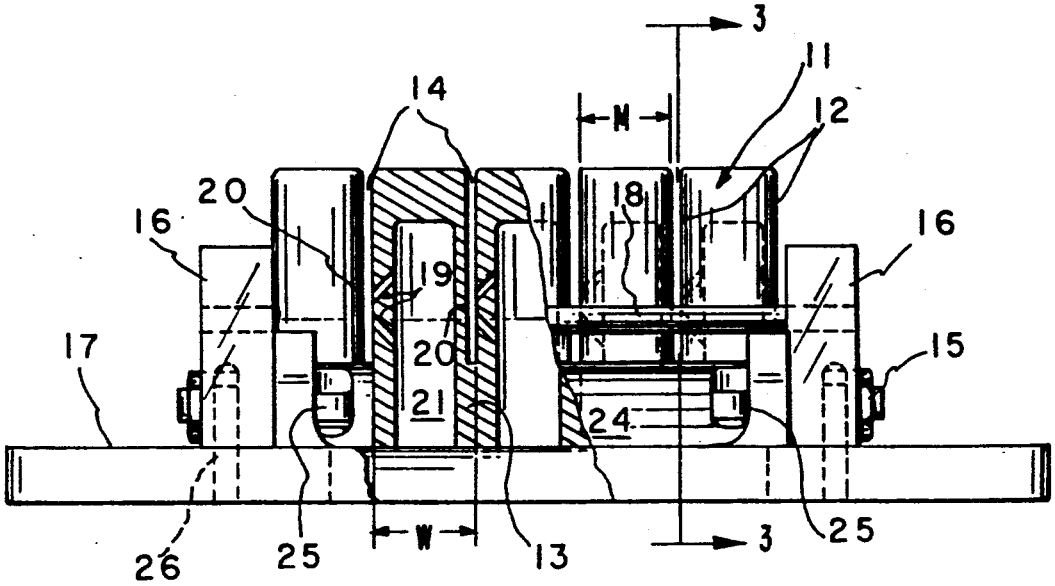
FIG. 2 shows an elevation view, partially in section, of the assembly of FIG. 1.
Figure 3:
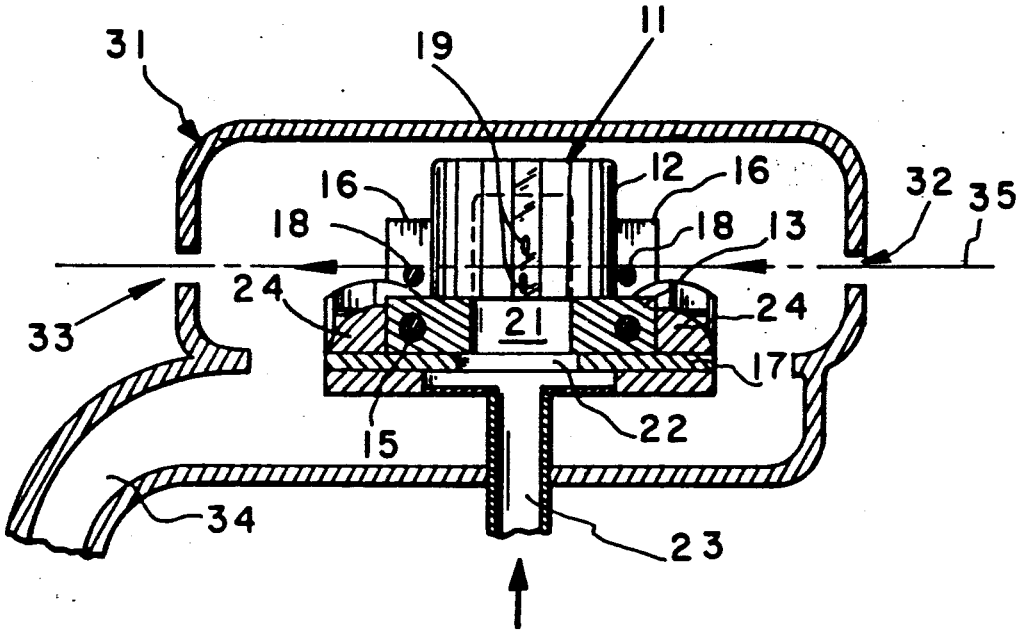
FIG. 3 shows a view of the assembly of FIG. 2, taken along the line 3—3', and shows the assembly mounted within an enclosure, and with a yarn passing therethrough.

Referring to FIGS. 1, 2 and 3, a preferred jet assembly comprises a series of jet members 11 with wall members 12 that have an essentially oval cross sectional configuration, as can be seen most clearly in FIG. 1, on rectangular bases 13, the rectangular bases 13 being of widths (W) greater than the minor axes (M) of the oval-shaped wall members 12, so as to provide yarn passageways 14 between adjacent wall members 12. Five such members 11 are shown assembled so as to provide four yarn passageways 14 between pairs of adjacent wall members 12. The members 11 are secured together by longitudinal bolts 15 in retaining members 16 which may house the ends of rails 18 and may be located on a manifold body 17 by pins 26, while clamps 24 secure the bases 13 to the body 17, and are themselves secured by screws 25. One side of such a yarn passageway 14 is defined by a wall member containing two vertically-spaced, inclined and opposed conduits or jets 19, for pressurized fluid, whereas the other side of the yarn passageway acts as a striker surface 20 for the fluid projected through such jets. The jets 19 communicate with hollow passageways 21 within the jet members 11 and bases 13, and in turn with an opening 22 that communicates in turn with a fluid inlet 23 connected to a source of supply (not shown).

In FIG. 3, a yarn 35 is shown passing through an assembly from a source of supply (not shown), that could be an extrusion orifice in the case of a spinning machine. This jet assembly is shown surrounded by an optional enclosure 31, provided with a yarn inlet 32 and a yarn outlet 33, and with a fluid outlet drain 34 to separate excess fluids from the emerging yarn and exhaust them separately. To assist in this desirable purpose, curved surfaces are preferably provided upstream and downstream for the clamps 24, so as to guide fluids smoothly away from the vicinity of the yarn passageways 14.

The prior jet assemblies already referred to comprise a series of rectangular jet members with wall members on bases of widths greater than the widths of the wall members, so as to provide parallel-sided spaces therebetween to act as yarn passageways, one side of such members acting as a striker plate, while the other contains the fluid jets.

The contrast may be seen most clearly by comparing FIG. 1 with item 12 of FIG. 1 of Harris. The oval-shaped configurations in FIG. 1 contrast with the rectangular configurations shown by Harris. It will be noted that our yarn passageways 14 flare outwardly with the wall members being gently curved convexly, in contrast with Harris' rectangular members that define yarn passageways having a width therebetween that is essentially constant along the whole passageway. The cross-sectional configurations need not be geometric ellipses, as can be seen from FIG. 1. Indeed, at these "narrows" (where the jets and striker zone are located), the surfaces may be essentially straight, i.e., essentially parallel, to provide for more precise control of the dimensions at this location. A gentle curvature (i.e. a large radius) is preferred, as a gentle curve is believed to provide better self-cleaning performance, i.e., less deposites in the yarn passageway. For the jets of the invention for which results are reported herein, the radius of curvature is about 1 inch for each curve on either side of these "narrows", whereas the surfaces flare outwardly more severely towards either end, so forming the preferred oval shape.

The same materials and dimensions may be used for the various parts of the interlacer otherwise essentially as used previously, and, for example, as described in the literature on jets, including those mentioned above and Clendening U.S. Pat. No. 3,261,071 by way of example. Such aforementioned prior references are accordingly hereby specifically included herein by reference, including the Harris U.S. Pat. No. 4,932,109.

Significant improvements in interlace obtained with the jets of the invention (OVAL), illustrated in FIG. 1, as compared with those prior (RECT) jets are shown in Table 1, giving interlace levels (as RPC) averaged over the number of measurements (given as N), and the standard deviations (given as SD). This test compared the interlace obtained for 3 polyester yarns (indicated conventionally by total denier-number of filaments) spun at speeds of about 4000 mpm under essentially identical comparative conditions except for the difference in interlacing jets, operated at the indicated air pressures (in psig).

TABLE 1

| | Yarn | | | | | | | | |
|---|---|---|---|---|---|---|---|---|---|
| | 150-68 | | | 75-34 | | | 75-50 | | |
| | Pressure | | | | | | | | |
| | 75 | | | 70 | | | 47 | | |
| | RPC | SD | N | RPC | SD | N | RPC | SD | N |
| RECT | 5.74 | 0.89 | 338 | 5.48 | 0.51 | 2311 | 6.30 | 0.81 | 304 |
| OVAL | 4.51 | 0.44 | 128 | 5.08 | 0.47 | 776 | 5.04 | 0.56 | 290 |

As can be seen from Table 1, the oval jets of the invention gave consistently better interlace, as indicated by lower RPC and SD values. The lower spread of values shows better uniformity of interlace. This is particularly important, as defects in downstream processing of the yarns can result from even an occasional high RPC value, indicating a greater length between the interlacing nodes. This importance of uniform interlace can be seen in Table 2, showing interlace measurements on yarns spun on 3 spinning machines using essentially similar conditions except for the interlace jets, conventional (RECT) jets being used on two machines in comparison with jets of the invention (OVAL).

TABLE 2

| Jets | N | RPC | SD | VAR | MAX | >6.5(%) | >7(%) | >7.5(%) |
|---|---|---|---|---|---|---|---|---|
| 1-RECT | 538 | 6.04 | 0.565 | 0.319 | 8.85 | 94(18) | 33(6) | 7(1) |
| 2-RECT | 470 | 5.98 | 0.618 | 0.382 | 8.28 | 78(16) | 34(7) | 9(2) |
| 3-OVAL | 499 | 5.52 | 0.407 | 0.165 | 6.90 | 7(1) | 0 | 0 |

Although the improvement in interlace level as shown by a lower RPC for the oval jets of the invention is significant by itself, the other improvements are of even more importance. The better (lower) standard deviation (SD) and variance (VAR) from the oval jets show an improvement in uniformity. This is even more apparent from the lower values for the maximum interlace levels measured (MAX) and the number of measurements over 6.5 RPC (>6.5), over 7 RPC (>7) and over 7.5 RPC (>7.5), which are given as absolute numbers and as percentages of the total numbers of measurements. Any intermittent sections of yarn having higher interlace levels than desired can and do lead to problems downstream, especially in broken threadlines during knitting. Over a longer test period, use of oval jets has improved the variance by more than 50%, and tightened the interlace by about 15% over the values obtained with the rectangular jets, and this has provided a significant improvement in knitting performance, measured as about a 20% increase in the number of racks/broken threadline.

Table 3 shows that satisfactory interlace can be achieved with less air pressure using the oval jets. This can provide an important saving. These measurements for each yarn totaled 576 and were made on a 50-34 polyester filament yarn.

TABLE 3

| | RPC | Jet Pressure (psig) |
|---|---|---|
| RECT | 6.26 | 57 |
| OVAL | 5.50 | 52 |

A reduction of about 10% in the air pressure while improving the interlace level indicates a significant and unexpected improvement in efficiency. Further advantages have also been found in practice, including easier yarn string-up and easier maintenance, such as easier access for cleaning the yarn passageways to remove deposits, e.g. of finishes that tend to build-up in and around the jet assembly, such as are mentioned by Harris. These deposits can depend significantly on the particular materials and compositions used, and a reduction in such deposits is of importance in practical operation. Significantly less deposits have been noted when using the oval jets, in contrast with the rectangular jets. This means that the above comparisons understate the practical advantages of using the oval jets, since both types were cleaned after operating for similar periods. The reduction in deposits and the improved access to the yarn passageways that facilitates cleaning of the jets are important advantages of the invention over the rectangular assemblies that were previously used, so the invention provides in practice better (and more predictable) uniformity of the interlace on yarns produced from jet to jet.

TEST METHOD

A procedure for rapidly measuring interlace on a device is described by Hitt in U.S. Pat. No. 3,290,932. This was used to measure all the interlace herein as RPC. As explained, any interlace level is measured according to the distance between interlace nodes. The device is understood to convert these node length distances in cm to RPC, i.e., to 10 log 10 values thereof.

We claim:

1. An interlacing jet comprising a striker surface and a wall member containing at least one conduit projecting a stream of pressurized fluid against said striker surface, said wall member and said striker surface defining therebetween a passageway with an entrance and an exit at either end for a yarn, wherein said striker surface and said wall member are gently convexly curved whereby the entrance and exit of said yarn passageway are flared outwardly with respect to the location where said stream is projected against said striker surface.

2. An interlacing jet comprising a striker surface, and a wall member containing a pair of conduits with vertically spaced, inclined and opposed axes, said conduits projecting streams of pressurized fluid against said striker surface, said wall member and said striker surface defining therebetween a passageway with an entrance and an exit at either end for a yarn, the improvement wherein said striker surface is gently convexly curved whereby the entrance and exit of said yarn passageway are flared outwardly with respect to the location where said stream is projected against said striker surface.

3. An interlacing jet according to claim 2, wherein both said wall member and said striker surfaces are convexly curved.

4. An interlacing jet according to claim 3, characterized in that a plurality of such jet members are assembled in side-by-side relationships whereby a plurality of yarn passageways are provided between adjacent jet members with wall members that are convexly curved on one side to provide a striker surface and on another side that contains at least one said conduit.

5. A stacked interlacing jet assembly comprising a plurality of jet members, with walls, that are assembled to provide a plurality of yarn passageways between walls of adjacent jet members, said jet members being essentially oval in cross-section and containing fluid conduits located on one side of said yarn passageways, and projecting streams of pressurized fluid against the opposing wall of the adjacent jet member located on the other side of said yarn passageways.

6. An stacked interlace jet assembly comprising a plurality of jet members with walls that are assembled to provide a plurality of yarn passageways between walls of adjacent jet members, said walls containing fluid conduits each projecting a stream of pressurized fluid against the opposing wall of the adjacent jet member located on the other side of said yarn passageway, the improvement wherein both said walls are convexly curved whereby said yarn passageways are outwardly flared at least downstream from the location of said conduits.

7. An assembly according to any of claims 1 to 6 wherein said jet members are secured by clamps that have surfaces that are convexly curved at least in the vicinity of the yarn passageways.

* * * * *